US010230178B2

(12) United States Patent
Droesbeke et al.

(10) Patent No.: US 10,230,178 B2
(45) Date of Patent: Mar. 12, 2019

(54) CABLE CONNECTOR

(71) Applicant: Amphenol FCI Asia Pte. Ltd., Singapore (SG)

(72) Inventors: Gert Droesbeke, Chartres (FR); Gerard Marie Leon Pequignot, Serre les Sapins (FR)

(73) Assignee: Amphenol FCI Asia Pte Ltd, Singapore (SG)

( * ) Notice: Subject to any disclaimer, the term of this patent is extended or adjusted under 35 U.S.C. 154(b) by 0 days.

(21) Appl. No.: 14/893,995

(22) PCT Filed: Jun. 7, 2013

(86) PCT No.: PCT/IB2013/001340
§ 371 (c)(1),
(2) Date: Nov. 25, 2015

(87) PCT Pub. No.: WO2014/195749
PCT Pub. Date: Dec. 11, 2014

(65) Prior Publication Data

US 2016/0104948 A1 Apr. 14, 2016

(51) Int. Cl.
*H01R 4/18* (2006.01)
*H01R 13/642* (2006.01)
(Continued)

(52) U.S. Cl.
CPC ..... *H01R 4/18* (2013.01); *H01R 13/11* (2013.01); *H01R 13/422* (2013.01);
(Continued)

(58) Field of Classification Search
CPC ..... H01R 13/11; H01R 13/422; H01R 13/642
(Continued)

(56) References Cited

U.S. PATENT DOCUMENTS 3,663,931 A * 5/1972 Brown ..... H01R 12/58 439/70
3,665,378 A * 5/1972 Hammell ..... H01R 13/428 439/748

(Continued)

FOREIGN PATENT DOCUMENTS

CN 1152807 A 6/1997
CN 1328361 A 12/2001

(Continued)

OTHER PUBLICATIONS

International Search Report and Written Opinion for International Application No. PCT/EP2013/075350 dated Jul. 18, 2014.

(Continued)

*Primary Examiner* — Edwin A. Leon
*Assistant Examiner* — Oscar Jimenez
(74) *Attorney, Agent, or Firm* — Wolf, Greenfield & Sacks, P.C.

(57) ABSTRACT

A connector, such as a cable connector, with terminal contacts including two parallel resilient contact beams and a third resilient beam. Tips of the two parallel resilient beams are forced apart by the third resilient beam. The third beam can also be a resilient contact beam, e.g., extending into a direction opposite to the direction of the other two contact beams.

25 Claims, 11 Drawing Sheets

Figure 1B:
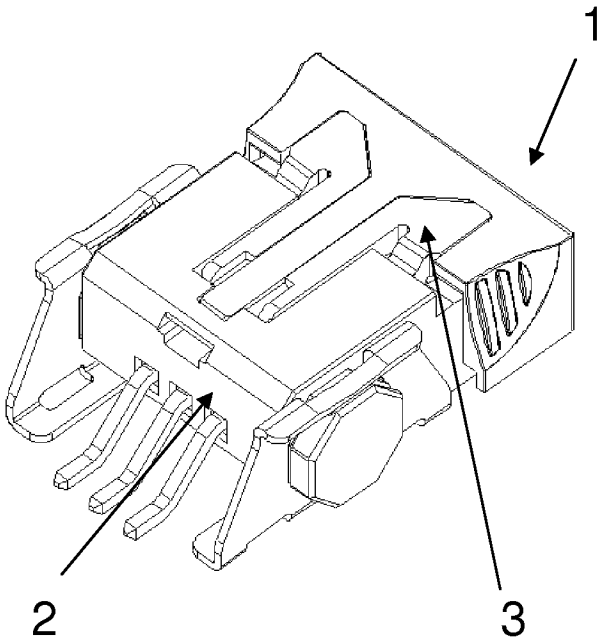

(51) Int. Cl.

| | |
|---|---|
| ***H01R 13/422*** | (2006.01) |
| ***H01R 13/424*** | (2006.01) |
| ***H01R 13/11*** | (2006.01) |
| ***H01R 13/436*** | (2006.01) |

(52) U.S. Cl.
CPC ..... *H01R 13/424* (2013.01); *H01R 13/642* (2013.01); *H01R 4/185* (2013.01); *H01R 13/4368* (2013.01)

(58) Field of Classification Search
USPC ..... 439/595, 843, 851–852, 856–857, 891
See application file for complete search history.

(56) References Cited

U.S. PATENT DOCUMENTS 3,781,770 A 12/1973 Manicini
3,823,392 A 7/1974 Pfeifer
3,836,947 A 9/1974 Yeager
4,317,609 A * 3/1982 Lapraik ..... H01R 12/721 439/636
4,379,611 A * 4/1983 Foege ..... H01R 12/58 439/747
4,480,386 A * 11/1984 Adams ..... H01R 13/114 29/874
4,720,272 A * 1/1988 Durand ..... H01R 33/09 439/375
4,722,704 A 2/1988 VanDerStuyf et al. ..... 439/851
4,898,548 A 2/1990 Case et al. ..... 439/686
4,900,271 A 2/1990 Colleran et al.
4,950,183 A 8/1990 Watanabe
5,252,097 A * 10/1993 Lindeberg ..... H01R 13/11 439/842
5,259,796 A 11/1993 Yamada et al.
5,281,175 A 1/1994 Chupak et al.
5,344,194 A 9/1994 Hatagishi et al.
5,382,177 A 1/1995 Hutchinson, Jr. et al.
5,575,671 A 11/1996 Katsuma
5,593,328 A 1/1997 Okada et al.
5,651,700 A 7/1997 Sato et al.
5,658,174 A 8/1997 Benes et al.
5,681,190 A 10/1997 Childs
5,690,517 A 11/1997 Betsui
5,735,717 A 4/1998 Nabeshima
5,762,524 A * 6/1998 Ford ..... H01R 13/521 439/589
5,865,636 A * 2/1999 Myer ..... H01R 13/5221 439/275
5,897,405 A 4/1999 Endo
5,938,485 A 8/1999 Hotea et al.
5,951,339 A * 9/1999 Chaillot ..... H01R 13/113 439/852
6,039,615 A 3/2000 Suzuki et al.
6,174,208 B1 * 1/2001 Chen ..... H01R 13/113 439/752.5
6,186,810 B1 2/2001 Barnabe et al.
6,193,551 B1 2/2001 Yamamoto et al.
6,299,489 B1 10/2001 Phillips et al.
6,305,992 B1 10/2001 Bouda et al.
6,315,591 B2 11/2001 Oda et al.
6,338,638 B2 1/2002 Kodama
6,379,199 B1 * 4/2002 Chen ..... H01R 13/11 439/451
6,402,571 B1 * 6/2002 Muller ..... H01R 13/18 439/745
6,439,935 B2 8/2002 Saka et al.
6,447,345 B2 9/2002 Sato et al.
6,475,040 B1 11/2002 Myer et al.
6,524,135 B1 * 2/2003 Feldman ..... H01R 9/035 439/607.46
6,547,608 B2 4/2003 Sato et al.
6,558,176 B1 5/2003 Martin et al.
6,585,544 B2 7/2003 Furutani
6,669,507 B2 12/2003 Yamanashi et al.
6,679,736 B2 * 1/2004 Saka ..... H01R 13/432 439/748
6,736,684 B2 5/2004 Ishiyama
6,755,697 B2 6/2004 Kojima et al.
6,971,927 B2 12/2005 Anbo et al.
7,048,582 B2 5/2006 Tabata et al.
7,144,281 B2 12/2006 Maeda
7,156,704 B2 1/2007 Shimizu
7,179,138 B2 2/2007 Nora et al.
7,252,564 B1 8/2007 Morello et al.
7,278,883 B2 10/2007 Tyler
7,294,027 B1 11/2007 Tyler
7,300,319 B2 11/2007 Lutsch et al.
7,303,027 B1 12/2007 Laemmer
7,351,122 B2 4/2008 Suemitsu et al.
7,442,058 B2 10/2008 Ohtaka et al.
7,938,695 B2 5/2011 Furutani et al.
7,950,972 B1 5/2011 Chen et al.
7,976,351 B2 7/2011 Boemmel et al.
8,043,130 B2 10/2011 Casses et al.
8,241,076 B2 8/2012 Kubota
8,241,077 B2 8/2012 Suzuki et al.
8,747,156 B2 6/2014 Hirabayashi
8,974,256 B2 3/2015 Okano et al.
9,011,186 B2 4/2015 Wirth et al.
9,039,467 B2 5/2015 Seipel et al.
9,054,431 B2 6/2015 Endo
9,130,282 B2 9/2015 Suzuki et al.
9,136,641 B2 * 9/2015 Bishop ..... H01R 4/4836
9,166,325 B2 * 10/2015 Bishop ..... H01R 12/57
9,466,893 B2 * 10/2016 Bishop ..... H01R 4/4836
9,570,854 B2 2/2017 Hashimoto
9,601,854 B2 3/2017 Kutsuna et al.
2001/0051472 A1 12/2001 Sato et al.
2002/0076999 A1 6/2002 Chen
2002/0160666 A1 10/2002 Sato et al.
2003/0054681 A1 3/2003 Hatagishi et al.
2003/0057958 A1 3/2003 Fukushima et al.
2003/0199185 A1 10/2003 Fujii et al.
2003/0220015 A1 11/2003 Ishiyama
2004/0142605 A1 * 7/2004 Harada ..... H01R 4/185 439/857
2005/0153605 A1 7/2005 Anbo et al.
2005/0227551 A1 10/2005 Tabata et al.
2005/0287877 A1 12/2005 Fukuda et al.
2006/0035538 A1 2/2006 Suemitsu et al.
2006/0073741 A1 4/2006 Bommersheim
2006/0094305 A1 5/2006 Masaki et al.
2006/0234535 A1 10/2006 Ohtaka et al.
2008/0070452 A1 3/2008 Komiyama et al.
2008/0280510 A1 11/2008 Moll et al.
2010/0015863 A1 1/2010 Sugiyama et al.
2010/0197177 A1 8/2010 Myer et al.
2010/0197178 A1 8/2010 Hotea et al.
2011/0053405 A1 3/2011 Kobayashi et al.
2011/0086557 A1 4/2011 Kubota
2011/0117761 A1 5/2011 Loncar et al.
2011/0151694 A1 6/2011 Horiuchi et al.
2011/0212656 A1 9/2011 Suzuki et al.
2012/0034827 A1 2/2012 Ishikawa et al.
2012/0142233 A1 6/2012 Blasko et al.
2012/0214360 A1 8/2012 Kumakura et al.
2012/0264340 A1 * 10/2012 Mueller ..... H01R 13/112 439/861
2012/0295493 A1 11/2012 Hirabayashi
2012/0329341 A1 12/2012 Morikawa et al.
2013/0017697 A1 1/2013 Furuya et al.
2013/0102180 A1 4/2013 Muro
2013/0143454 A1 6/2013 Onuma et al.
2013/0288546 A1 10/2013 Okano et al.
2013/0288547 A1 10/2013 Amano et al.
2014/0287621 A1 9/2014 Smutny et al.
2015/0050838 A1 2/2015 Copper et al.
2015/0222038 A1 8/2015 Volpone et al.
2015/0263453 A1 9/2015 Wang et al.
2015/0303593 A1 10/2015 Ono

(56) References Cited

U.S. PATENT DOCUMENTS

| | | | |
|---|---|---|---|
| 2016/0118745 | A1 | 4/2016 | Droesbeke et al. |
| 2016/0359251 | A1 | 12/2016 | Droesbeke et al. |

FOREIGN PATENT DOCUMENTS

| | | | |
|---|---|---|---|
| CN | 102119470 | A | 7/2011 |
| CN | 102195182 | A | 9/2011 |
| CN | 202651500 | U | 1/2013 |
| CN | 102971918 | A | 3/2013 |
| DE | 10 2004 052 378 | A1 | 5/2006 |
| DE | 10 2006 062704 | A1 | 2/2008 |
| DE | 202013001074 | U1 | 4/2013 |
| JP | H11-40233 | A | 2/1999 |
| JP | 2000-067975 | A1 | 3/2000 |
| JP | 2000-173703 | A | 6/2000 |
| JP | 2001-135398 | A | 5/2001 |
| JP | 2003-022872 | A | 1/2003 |
| JP | 2003-068397 | A | 3/2003 |
| JP | 3390331 | B2 | 3/2003 |
| JP | 2005-302581 | | 10/2005 |
| JP | 2009-283308 | A | 12/2009 |
| WO | WO 2010/015894 | A1 | 2/2010 |
| WO | WO 2011/067632 | A1 | 6/2011 |
| WO | WO 2011/087863 | A2 | 7/2011 |
| WO | WO 2013/046663 | A1 | 4/2013 |

OTHER PUBLICATIONS

International Preliminary Report on Patentability for International Application No. PCT/EP2013/075350 dated Jun. 16, 2016.

International Search Report and Written Opinion dated Feb. 3, 2014 for Application No. PCT/IB2013/001340.

International Preliminary Report on Patentability dated Dec. 17, 2015 for Application No. PCT/IB2013/001340.

Extended European Search Report dated Feb. 21, 2017 for Application No. EP 14838530.5.

International Search Report and Written Opinion dated Nov. 21, 2014 for Application No. PCT/US2014/051203.

U.S. Appl. No. 15/101,533, filed Jun. 3, 2016, Droesbeke et al.

International Preliminary Report on Patentability dated Mar. 3, 2016 for Application No. PCT/US2014/051203.

* cited by examiner

CABLE CONNECTOR

The invention relates to a cable connector configured to be coupled with a pin header connector.

Such cable connectors are for instance used in automotive applications, e.g., for cooperation with an on-board pin header connector on a printed circuit board or a similar substrate.

It is an object of the invention to provide a cable connector with a reduced pitch between the pin receiving contacts enabling good and reliable contact with pin contacts of a complementary pin header connector.

The object of the invention is achieved with a connector comprising one or more terminal contacts, each of the one or more terminal contacts comprising two parallel resilient contact beams and a third resilient beam, with tips of the two parallel resilient beams forced apart by the third resilient beam. The third beam preloads the first two contact beams before insertion of a contact pin. This results in a higher contact pressure. Due to the preloading the contact force can be substantially higher than the elastic reaction force of the respective contact beams during insertion of a contact pin. Contact force can be maximized up to the yield strength of the contact beam material.

The third beam can for instance be a third contact beam or a latch received in a cavity of the connector housing in a latching manner.

The third beam can extend into the same direction as the other beams or in an opposite direction. Reverse positioning of the third beam allows a compact build-up. The third beam may for instance extend into a contact pin insertion direction.

The terminal contacts can for instance comprise a backbone connected to the two parallel contact beams by two oppositely arranged flanges at either side of the strip and connected to the third beam by a third flange, wherein the backbone is arranged opposite to the third contact beam. The backbone and the three beams define a pin receiving cavity with a pin receiving opening confined by:

the third beam;

the third flange bridging the third beam and the backbone;

the backbone; and optionally a fourth flange opposite to the third flange.

With such a four-sided pin receiving opening the terminal contact surrounds the received contact pin. The terminal contact can remain floating and self-aligning within the respective cavity of the housing. As a result an assembly of the connector with a complementary pin header connector becomes less sensitive to vibrations, since the terminal contacts do not fully transfer vibrations between the pin header connector and the housing part of the cable connector.

Optionally, a gap remains between the fourth flange and the third contact beam to provide additional flexibility and manoeuvrability to the backbone. Alternatively, the fourth flange can be connected to the third contact beam, e.g., by welding or soldering to provide a more rigid structure.

In a specific embodiment the fourth flange may project from an upper face of the third beam to form a flag providing a keying feature and/or providing a retention lock avoiding disconnection of the terminal contact by pulling the cable. The terminal contact can be further locked if the projecting end of the fourth flange comprises a hook.

A further embodiment may comprise a traverse flange parallel to the base strip extending from one of the flanges carrying the first or second contact beams towards the other one of the flanges. This creates a second pin receiving opening in line with the first pin receiving opening. Optionally, the third beam extends from the traverse flange into the same direction as the other contact beams.

The terminal contact may comprise two or more flags, e.g., in line with each other at the same longitudinal side of the terminal contact, or at opposite longitudinal sides of the terminal contact, more particular at opposite ends of opposite sides. Besides providing keying features and pull retention, such flags also shield the contact beams from impact loads, particularly during assembly of the cable connector or during attachment of the terminal contact to a cable. The flags can be positioned in complementary slots or recesses in the cable connector housing, e.g., with a press fit connection or in a floating manner. This way, the flags help to keep the terminal contacts substantially straight and in place during assembly of the cable connector.

One of the flanges carrying the first or second contact beams can also project from an upper face of the third beam, to provide a further retention lock.

Optionally, the three contact beams are differently dimensioned, e.g., having different lengths, widths and/or stiffness to provide different resonance frequencies, resulting in better resistance against loosening by vibration.

The three contact beams and the backbone can for example be configured to provide staggered contact points to contact a pin of a mating pin connector. As a result, an inserted contact pin of a mating connector will not engage the contact points of the three beams simultaneously but successively, requiring less insertion force and allowing easier insertion of a pin.

The terminal contacts will typically be provided with a cable connection at the end opposite to the pin receiving end. The cable connection can for example be a crimp connection or any other suitable type of cable connection.

To facilitate easy assembly of the cable connector the cable connector can for example comprise a clip with one or more receiving cavities, each cavity receiving a respective terminal contact, the clip being received in an outer housing. The cavities can be provided with one or more slots for receiving a corresponding number of flanges or flags of the terminal contact. The cavities will typically have an open end in line with a pin receiving opening of the terminal contact. For easy assembling, the cavities can be configured to facilitate lateral insertion of the terminal contacts. Different cavities may for instance be accessible from opposite sides of the clip.

Optionally, the cavities can be provided with a retention hook, e.g., a snap-fit hook, locking the terminal contact, e.g., at an end opposite to the pin receiving opening of the terminal contact. In a specific embodiment, the fourth flange of the terminal contact can be provided with a hook pointing towards a cable connection end of the terminal contact, while the clip comprises a snap-fit hook locking the cable connection end of the terminal contact. This way, the snap-fit hook and the hook of the fourth flange keep the terminal contact straight during assembly of the cable connector, e.g., when the clip with the terminal contacts is inserted into the outer housing.

In a specific embodiment, the terminal contacts comprise a backbone with a crimp connection at a cable connecting side and a pin receiving opening at an opposite side which is offset from the cable connecting side to space received contact pins from the crimp connection. This helps to prevent direct contact of the received contact pin with a wire brush of the cable end at the position of the crimp connections. Since the contact pins do not run into the wire brush, longer contact pins can be used providing a longer wiping length for cleaning contact points of the contact beams.

The offset pin receiving opening side of the backbone can for example be connected to the cable connection side of the backbone by a sloping backbone section. The sloping backbone section can be used as a guiding surface during assembly of the cable connector, in particular during insertion of a clip or a holder holding the terminal contacts in an outer housing with complementary guiding features.

Optionally, a partition or flag of the terminal contact can be positioned between the pin receiving opening and the crimp connection to shield contact pins from the crimp connection.

In a further aspect, a connector is disclosed comprising one or more terminal contacts comprising at least two resilient contact beams, which may for example be parallel to one another. The terminal contact may comprise a flange positioned at or immediately adjacent to a distal mating tip or respective distal mating tips of the two resilient contact beams. The flange or flanges may project in a direction substantially perpendicular to a wipe length of both of the two resilient contact beams. The flange or flanges may further define a hook. The flange and/or the hook may be used as a polarization feature that is received in a corresponding polarization cavity in the housing to properly align the terminal contact with respect to the housing.

The disclosed connectors are particularly useful for use in the automotive field, e.g., for connecting LED lamps to a PCB controlling and powering the LED lamps.

The invention will be further explained under reference to the accompanying drawings.

Figure 1A:
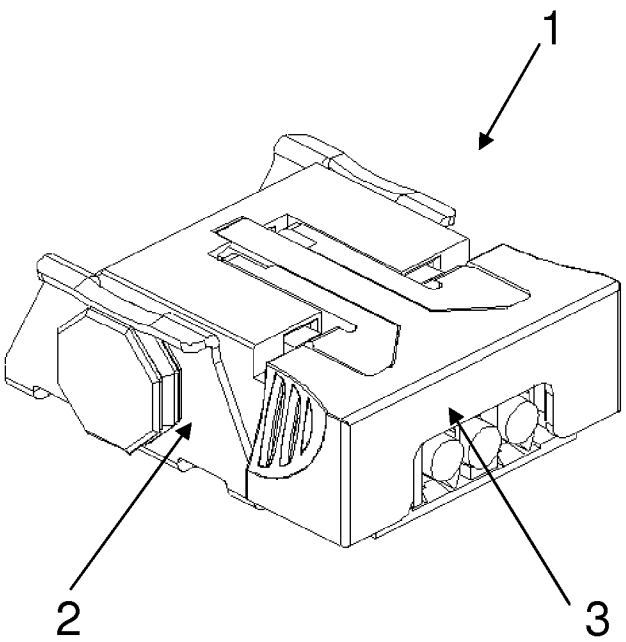
Figure 2C:
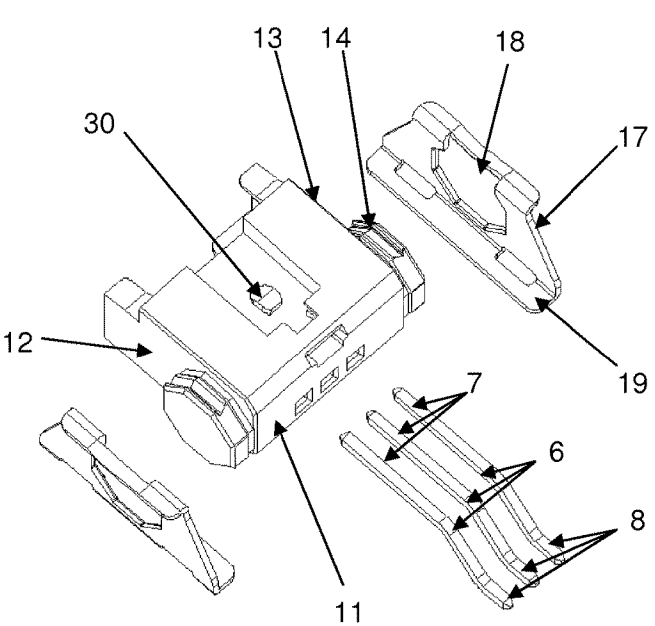
Figure 2A:
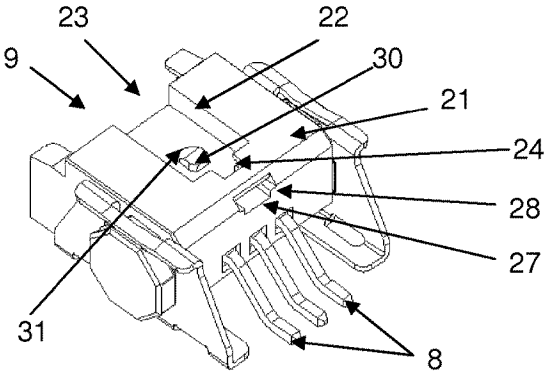
Figure 2B:
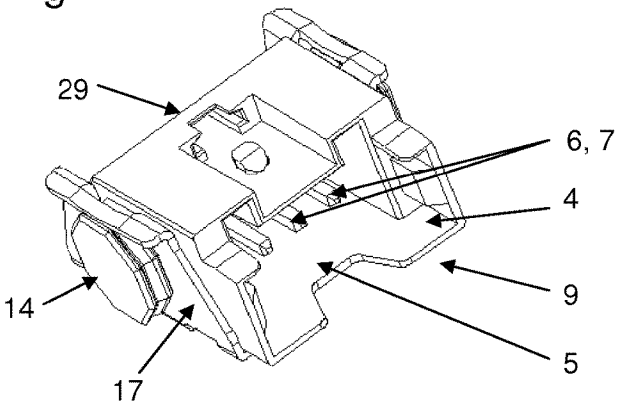
Figure 3C:
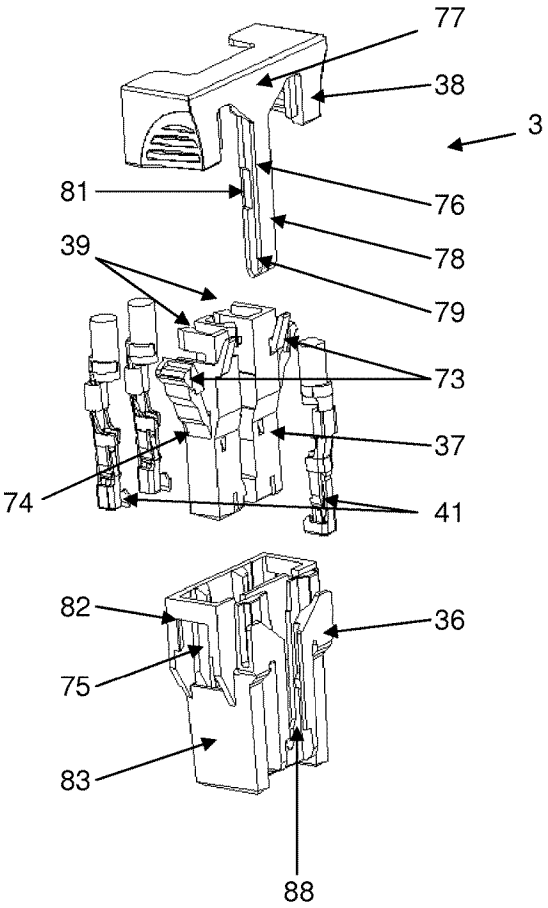
Figure 3A:
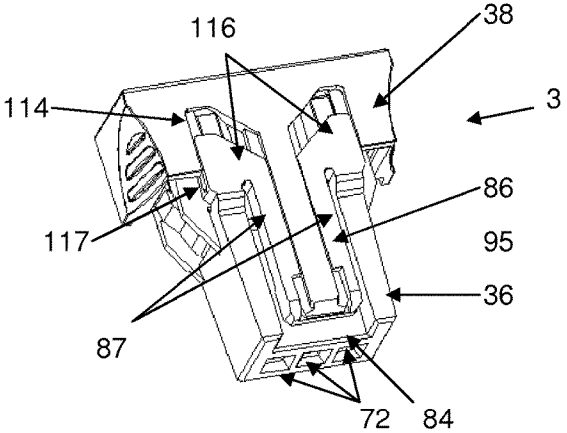
Figure 3B:
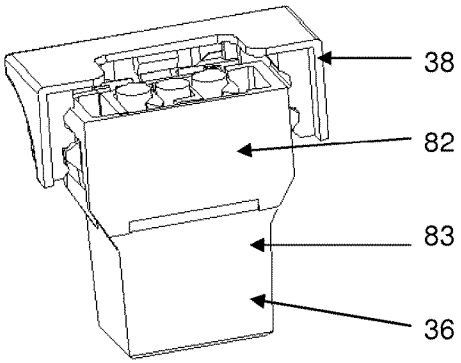
Figure 4:
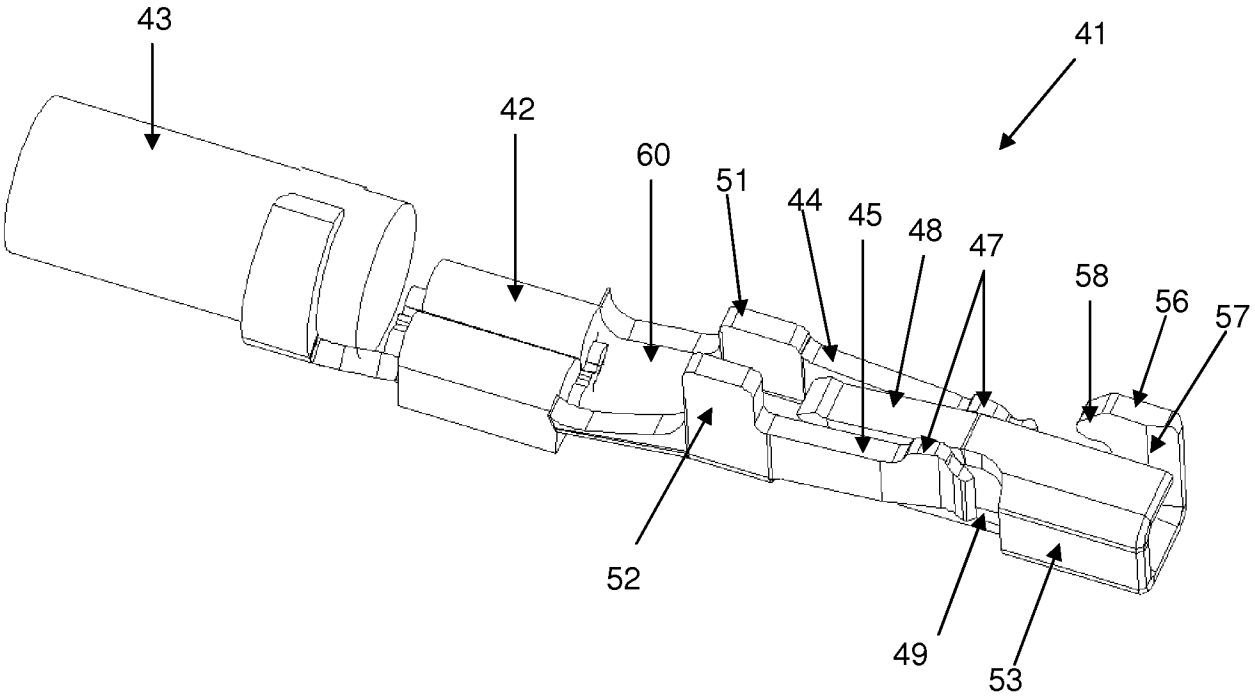
Figure 6:
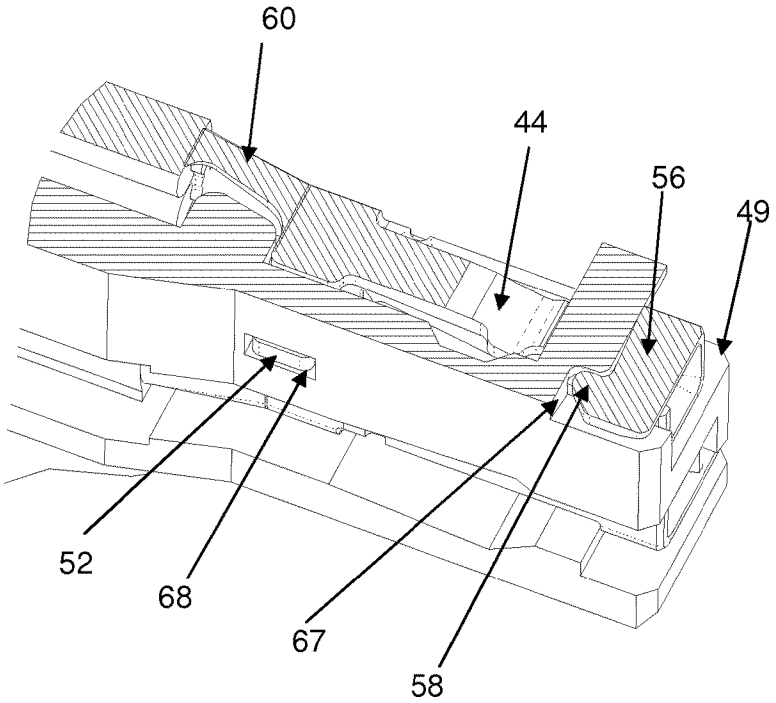
Figure 5:
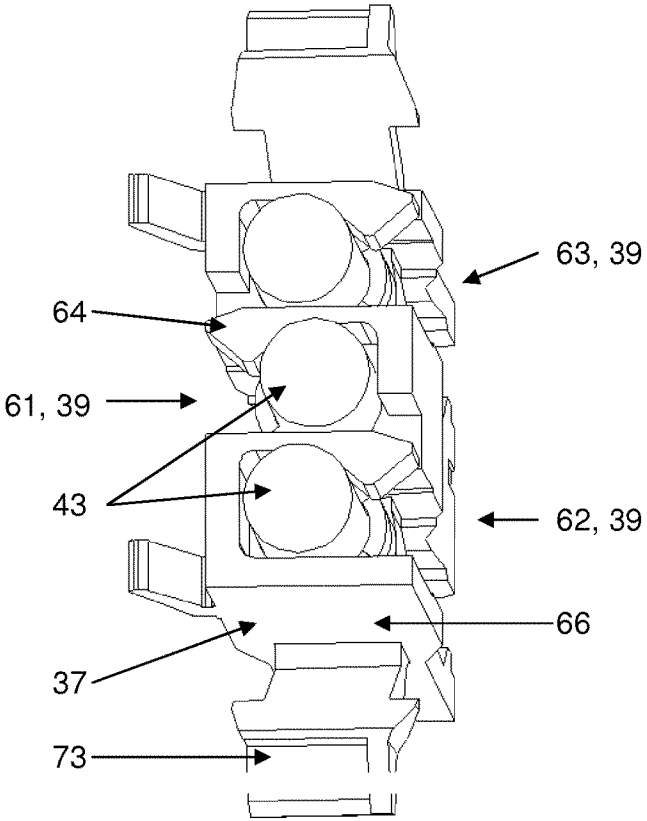
Figure 8:
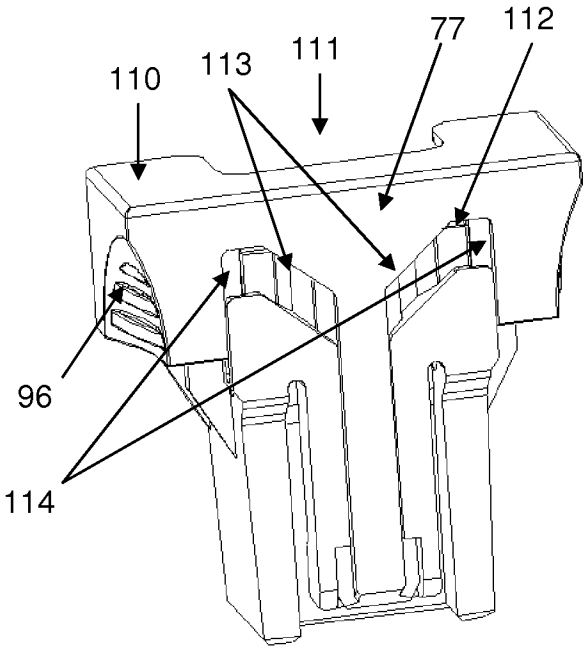
Figure 7:
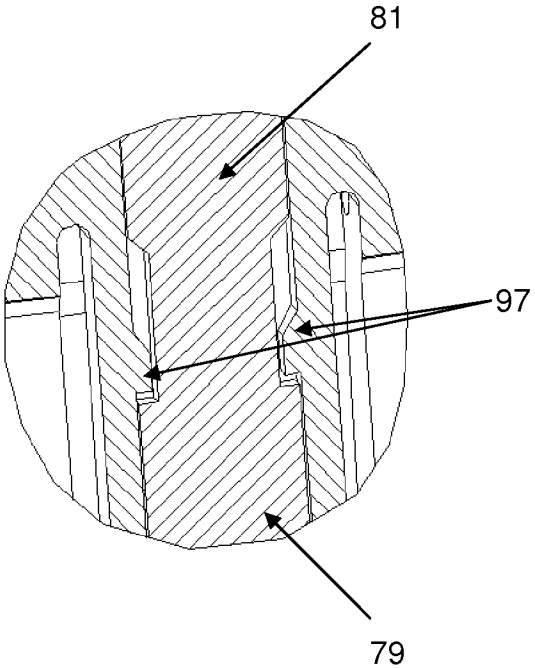
Figure 10A:
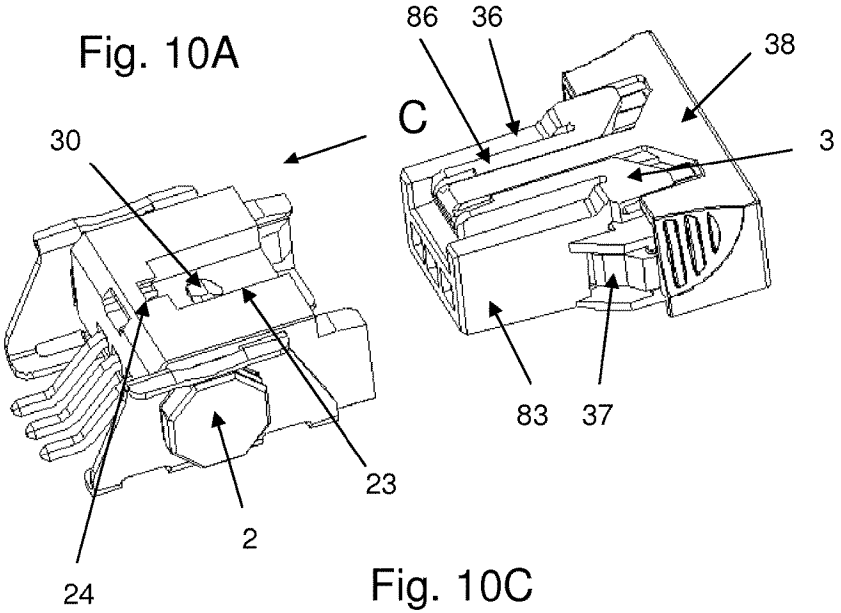
Figure 10B:
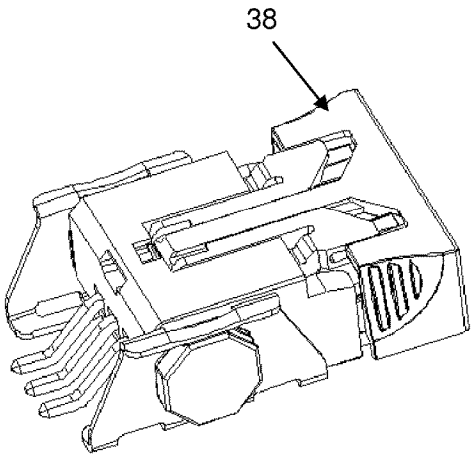
Figure 10C:
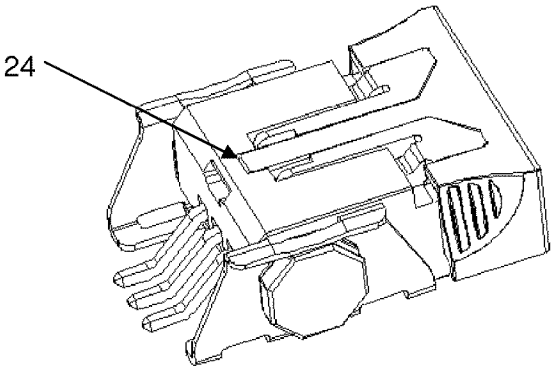
Figure 12:
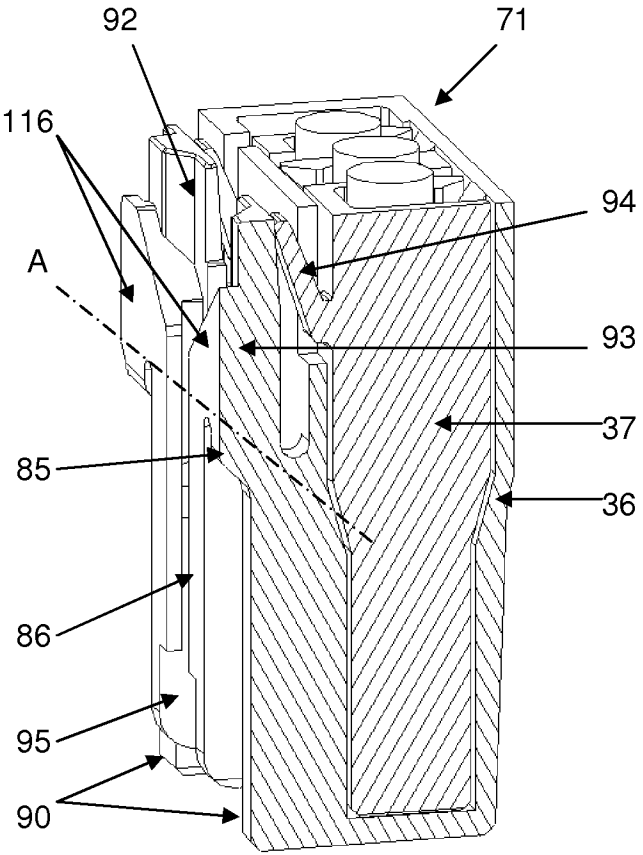
Figure 11:
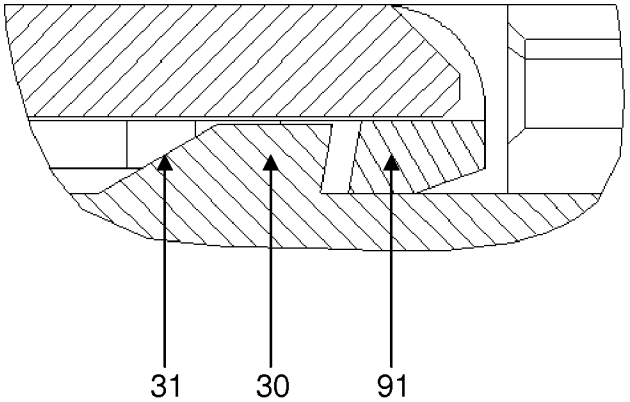
Figure 13:
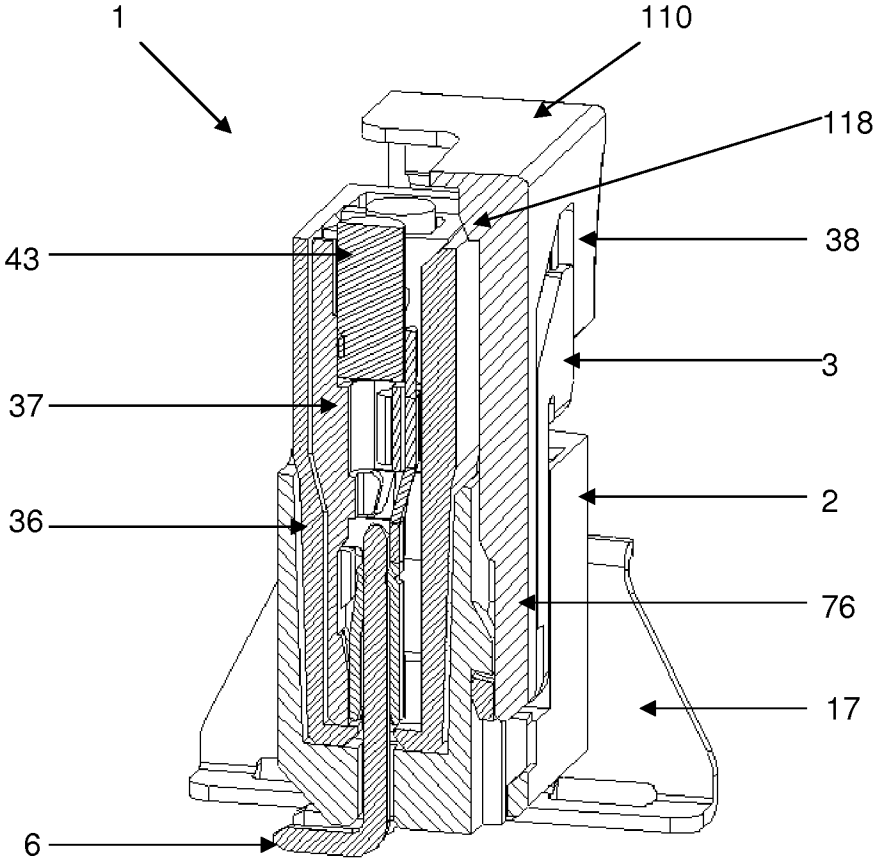
Figure 14:
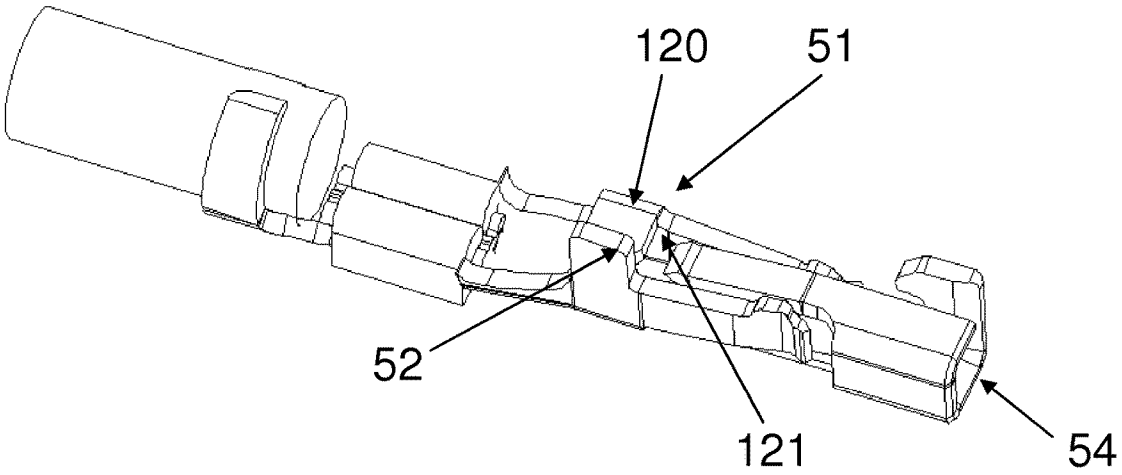
Figure 15:
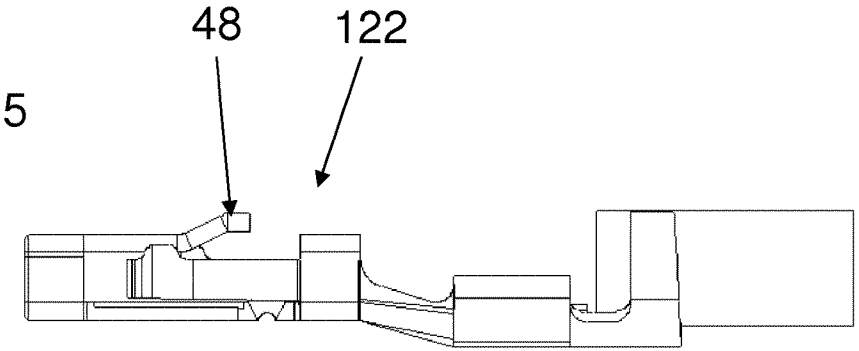

FIG. 1A: shows an exemplary embodiment of an assembly with a cable connector and a complementary pin header connector;

FIG. 1B: shows the assembly of FIG. 1A from a different view point;

FIG. 2A: shows the pin header connector of FIG. 1A;

FIG. 2B: shows the connector of FIG. 2A from a different view point;

FIG. 2C: shows the connector of FIG. 2A in exploded view;

FIG. 3A: shows the cable connector of FIG. 1A;

FIG. 3B: shows the connector of FIG. 3A from a different view point;

FIG. 3C: shows the connector of FIG. 3A in exploded view;

FIG. 4: shows a terminal contact of the cable connector of FIG. 3A;

FIG. 5: shows a detail of the cable connector of FIG. 3A;

FIG. 6: shows in detail two terminal contacts positioned in the cable connector of FIG. 3A;

FIG. 7: shows a detail of the cable connector of FIG. 3A;

FIG. 8: shows a housing with a slider lock of the cable connector of FIG. 3A;

FIGS. 9A-E: shows in cross section consecutive assembly steps of the cable connector of FIG. 2A;

FIGS. 10A-C: shows consecutive assembly steps of the assembly of FIG. 1A;

FIG. 11: shows in cross section a detail of the cable connector of FIG. 3A;

FIG. 12: shows in detail the inner side of the cable connector of FIG. 3A;

FIG. 13: shows the connector assembly of FIG. 1 in cross section;

FIG. 14: shows an alternative embodiment for a terminal contact;

FIG. 15: shows a further alternative embodiment for a terminal contact.

FIGS. 1A and 1B show two perspective views of an assembly 1 of an on-board pin header connector 2 on a printed circuit board (not shown) and a complementary cable connector 3.

The pin header connector 2 is shown separately in FIGS. 2A-C and comprises a hollow housing 4 and a plurality of parallel contact pins 6. Each contact pin 6 has one end 7 extending inside the cavity 5 of the housing (FIG. 2B), while its other end 8 extends outside the housing 4 (FIG. 2A) for connection to a printed circuit board (not shown).

The housing has an open front side 9 (see FIG. 2B), a closed back side 11 (see FIG. 2A) and two side faces 12, 13 provided with an octagonal projection 14. A hold down member 17 with an octagonal opening 18 fits over the octagonal projection 14 and comprises a lower flange 19 for connection to the printed circuit board. Due to the octagonal fit, the two hold down members 17 can fixate the pin header connector 2 in a horizontal position (see FIGS. 2A and 2B), a 45 degrees position or a vertical position (see FIG. 13).

The top side 21 of the housing 4 of the pin header connector 2 is provided with a recess 22 extending parallel to the longitudinal direction of the pins 6. A first section 23 of the recess 22 extends from the open side 9 of the housing 4 and has a rectangular cross sectional shape. A second section 24 of the recess 22 extends between the first section 23 and the closed back side 11 of the housing 4. At the second section 24 the width of the recess 22 is less than at the first section 23. Two oppositely directed flanges 26 narrow the open side of the recess 22 at the second section 24. At the second section 24 the recess has a narrower lower part 27 and a wider upper part 28. At the end face 11, the recess 22 is bridged by a strip 29.

Centred in the first section 23 of the recess 22 is a projection 30 with a height which is less than the depth of the recess 22 and with a front side 31 slanting down in the direction of the open side 9 of the housing 4. In the shown embodiment, the top side of the projection 30 is flat. In an alternative embodiment the top face may slant down in the direction of the strip 29, as will be explained here after.

FIGS. 3A-C show the cable connector 3, which comprises a housing 36, an inner clip 37 and a slider lock 38. As shown in FIG. 3C, the clip 37 comprises parallel slots 39 for receiving terminal contacts 41 extending between a cable entry side of the clip 37 and a pin receiving side of the clip 37.

A separate terminal contact 41 is shown in more detail in FIG. 4. Each terminal contact 41 has one end with a cable crimp connection 42 crimped to a cable end 43. The terminal contacts 41 comprise two parallel resilient contact beams 44, 45 with tips 47 forced apart by an oppositely directed third resilient contact beam 48. The third beam 48 preloads the two parallel contact beams 44, 45 resulting in a firm contact pressure with an inserted contact pin 6 of a complementary pin header connector 2.

A backbone 49 facing the third contact beam 48 is connected to the two parallel contact beams 44, 45 by two oppositely arranged flanges 51, 52 at either side of the backbone 49. The end of the backbone 49 is connected to the third contact beam 48 by a third flange 53. The flanges 51, 52, 53 and the contact beams 44, 45 are substantially under right angles with the backbone 49. The third contact beam 48 is parallel to the backbone 49.

A pin receiving opening 54 of the terminal contact 41 is confined by:

the third contact beam 48;

the third flange 53 bridging the third contact beam 48 and the backbone 49;

the backbone 49; and a fourth flange 56 opposite to the third flange 53.

A gap 57 remains between the fourth flange 56 and the third contact beam 48. The gap 57 provides additional flexibility to the backbone 49. The fourth flange 56 protrudes above an upper face of the third contact beam 48 and is provided with a hook 58 pointing in the direction of the cable crimp connection 42. The flexibility of the backbone 49 facilitates self-locking of the hook 58 into a corresponding retention slot.

The flange 52 that is in line with the third flange 53 protrudes above an upper face of the third contact beam 48 to form a key flange or flag.

The contact beam 45 in line with the third flange 53 is somewhat shorter than the contact beam 44 in line with the hooked fourth flange. As a result the three contact beams 44, 45, 48 provide staggered contact points to contact an inserted pin 6 of the pin header connector 2.

The terminal contacts 41 have a sloping middle section 60 connecting the side of the pin receiving opening 54 with the side of the crimp connection 42 (see also FIG. 6). The sloping section 60 offsets the pin receiving opening 54 from the crimp connection 42 to prevent direct contact between an inserted contact pin of a mating header connector with the crimp connection 42.

The terminal contacts 41 are clipped into the longitudinal slots 39 of the clip 37. The slots 39 are profiled to match the shape of the terminal contacts 41 to receive these in only one single possible position. The terminal contacts 41 fit into the slots 39 with a clearance fit to keep the contacts 41 floating within the assembled cable connector 3. This floating helps to reduce vibration sensitivity.

In the exemplary embodiment shown in the drawings, see, e.g., FIG. 5, the slots 39 of the clip 37 include a middle slot 61 accessible from one side of the clip 37, and two slots 62, 63 flanking the middle slot 61, which are accessible from an opposite side of the clip 37. At the cable entry side, the slots 39 are provided with flexible snap-fit hooks 64 snapping around the cable ends 43. A first slot 62 is formed between a hook 64 and a side wall 66 of the clip 37. The middle slot 61 and the third slot 63 are formed between two adjacent hooks 64 pointing in opposite directions.

During assembly, the first terminal contact 41 is clipped into the first slot 62. Subsequently, a second terminal contact 41 is clipped into the middle slot 61, thereby locking the first slot 62 with the first terminal contact 41. Similarly, the second terminal contact 41 is locked by clipping the third terminal contact 41 into the third slot 63.

The pin receiving side of the clip 37 is provided with a first retention slot 67 receiving the hook 58 of the respective terminal contact 41 (see FIG. 6). The gap 57 provides additional flexibility to the backbone 49 so the hook 58 can snap easier into the retention slot 67 during assembly, while the contact beams 44, 45 remain pre-loaded.

Similarly, also the projecting key flange 52 in line with the third flange 53 is received in a matching second retention slot 68 within the slot 39 receiving the terminal contact 39. The retention slots 67, 68 can be dimensioned in such a way that a tensile force exerted via the cable end will first stress the key flange 52 in the second retention slot 68. The hooked third flange 56 in the first retention slot 67 mainly serves as a back-up lock. However, if the tensile force slightly deforms the retention slot 68 holding key flange 52, it will also pull the hooked third flange 56 in the first retention slot 67. This provides an additional reaction force, by which the total reaction force is increased. This helps to reduce stresses at the area of the contact beams 44, 45.

After the terminal contacts 41 are clipped into the respective slots 39, the clip 37 can be pushed into the housing 36, as shown in FIG. 12. The housing 36 is formed as a symmetrical sleeve with a rectangular outline in cross section having an open cable entry side 71 and a pin entry side with a row of openings 72 (FIG. 3A). After assembly each opening 72 exposes a pin receiving opening 54 of an associated terminal contact 41.

The side faces of the clip 37 are provided with resilient flaps 73. The side edge 74 of the flap 73 directed to the pin entry side 72 is connected to the rest of the clip 37. Side faces of the housing 36 are provided with openings 75 receiving the resilient flaps 73 when the clip 37 is slid into the housing 36.

The slider lock 38 has a T-shaped body with a slider strip 76 centrally extending from a top edge 77 near the cable entry side 71 into the direction of the pin receiving side 72. The slider strip 76 has a narrow front part 78 symmetrically topping a wider backbone 79. The wider backbone 79 shows a narrowed section 81 about halfway its length (see FIGS. 3C and 7). The top edge 77 is flanged with a top flange 110 partly covering the cable entry side of the housing 36 and having a recess 111 defining a passage opening for the connected cables 43. The outer ends of the top edge 77 and the outer ends of the top flange 110 are connected by downwardly extending ears 96. The ears 96 have profiled surfaces to provide a better grip. The ears 96, the top flange 110 and the top edge 77 are orthogonal relative to each other. The top edge 77 has two symmetrically arranged recesses 112 at both sides of the slider strip 76. Both recesses 112 have a bevel top side 113, thus providing a broadening section of the slider strip 76 at the top edge 77. At the side opposite to the slider strip 76 both recesses 112 are provided with a slider rib 114 in the same plane as the backbone 79 of the slider strip 76.

The housing 36 has a wider upper part 82 at the cable entry side and a narrower lower part 83 at the pin receiving side (see FIG. 3B). A front side of the housing 36 comprises a recess 84 over the length of the narrower part 83 (see FIG. 3A). A U-shaped latch 86 with two parallel legs 87 extends above the recess 84. The legs 87 of the U-shaped latch 86 define a recess 85 for receiving the slider strip 76 and are provided with facing open sides or slits 88 for tightly receiving edges of the backbone 79 of the slider strip 76 in a sliding manner. This way the slider strip 76 and the U-shaped latch 86 have matching stepped cross sections. Alternatively, a dovetail cross section can be used, allowing to use a thinner slider strip 76 and a thinner U-shaped latch 86, so less space will be consumed by the connector assembly 1.

To minimize space consumption, the slider lock 38 and the latch 87 are flush with the outer surface of the pin header connector 2.

The top ends of the legs 87 are connected to flaps 116 shaped to fit within the recesses 112 in the top edge 77 of the slider lock 38. The slider ribs 114 of the slider lock top edge 77 are received in corresponding slits 117 at a side of the flap opposite to the side that lays against the slide strip 76. The slider ribs 114 in the slits 117 and the backbone 79 received in the slits 88 join the slider lock 38 and the outer housing 36 in such a way the slider lock 38 acts as an extended lever of the U-shaped latch 86.

In FIG. 12 the clip 37 and the housing 36 are shown without the slider lock 38 and with one side wall of the housing 36 broken away. A bridge 85 connects the flaps 116 to the side walls 90 of the recess 84. The legs 87 of the U-shaped latch 86 have a lower wall 92 extending to the cable entry side of the housing 36. This lower wall 92 and the flaps 116 are connected to the bridge 85 by a side wall 93. The lower walls 92, the side walls 93 and the bridge 85 form a first sliding guide for guiding the slider lock 38 into the desired position. A second sliding guide is formed by the slider ribs 114 received in the slits 117. The clip 37 is provided with resilient lips 94 pushing against the top ends of the lower walls 92 of the U-shaped latch 86 to bias the U-shaped latch 86 into a downwardly tilted position.

At the opposite end of the U-shaped latch 86 the lower walls 92 of the two legs 87 are connected by a bridge 91. The bridge 91 is configured to snap over the projection 30 in the recess on top of the pin header connector housing 2 (see FIG. 2A), as will be explained hereinafter. The resilient lips 94 of the clip 37 bias the bridge 91 to snap over the projection 30.

During assembly the base part 79 of the slider strip 76 is received in the oppositely arranged open slits 88 in the legs 87 of the U-shaped latch 86. This is shown in FIG. 7, which shows the slider strip 76 inside the slits 88 with the top wall bordering the slits 88 being broken away. About halfway their length the slits 88 are locally narrowed by two oppositely arranged cams 97, dimensioned to slide along the narrowed section 81 at the outer edge of the slider strip 76. When the slider strip 76 of the slider lock 38 is introduced into the slits 88, it will first abut gradually sloping edges of the two oppositely arranged cams 97. The U-shaped latch 86 is dimensioned in such a way that its walls bulge elastically to allow further passage of the slider strip 76. The cams 97 in the slits 88 snap into the narrowed section 81 of the slider strip 76, allowing the elastically bulged U-shaped latch 86 to buckle back into its original shape. The cams 97 and the part of the backbone 79 hooking behind the cams 79 are provided with edges under right angles with the sliding direction of the sliding strip. This way, the slider strip 76 cannot be pulled back out of the U-shaped latch 87 anymore and the latch 87 will not bulge outwardly anymore.

When the slider strip 76 is pushed into the U-shaped latch 87, the ears 96 of the slider lock 38 partly cover the top ends of the side faces of the housing 36 and the openings 75 with the resilient flaps 73 of the clip 37. This way, the risk of unintentional release of the clip 37 is effectively reduced. In this position, shown in cross section perspective view in FIG. 8, the outer ends of the slider strip 76 are in line with the outer end of the U-shaped latch 86.

Figure 9A:
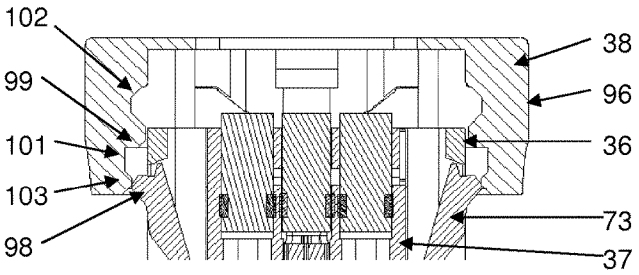
Figure 9B:
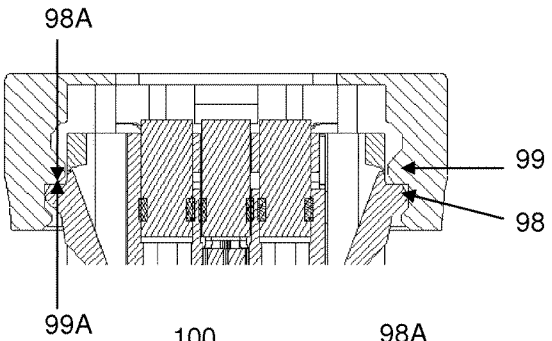

As shown in FIG. 9A-E, the flaps 73 of the clip 37 have top ends with profiled cams 98. Both ears 96 of the slider lock 38 have a set of two indentations separated by a stop 99: a lower indentation 101 and an upper indentation 102. The lower indentation 101 is bordered by a chamfered edge 103. When the slider lock 38 is pushed onto the housing 36 the chamfered edges 103 will push the flaps 73 of the clip 37 inwardly until the cams 98 of the flaps 73 snap into the lower indentation 101 and encounter the stop 99, as shown in FIG. 9B.

The assembly of slider lock 38, clip 37 and housing 36 can then be coupled to the pin header connector 2, as shown in FIGS. 10A-C in consecutive steps. To this end the narrower section 83 of the housing 36 is inserted into the open side of the pin header connector 2, while the U-shaped latch 86 holding the slider lock 38 is slid into the first section 23 of the recess 22 on the top face of the header connector housing 4. The U-shaped latch 86 snaps over the projection 30 in the recess 22 of the pin header connector 2. If the top face of the projection 30 slants down in the direction of the strip 29, as disclosed above, the projection 30 will pull the U-shaped latch 86 to snap into its final position.

The slider lock 38 effectively extends the housing 36 (see FIG. 10B) and accordingly forms an additional lever for manoeuvring the U-shaped latch 86. When the projection 30 snaps behind the bridge 91 of the U-shaped latch 86 a first audible click provides user feedback informing the user that the two connectors 2, 3 are connected and locked. In this position (see FIG. 10B) the mating face of the cable connector encounters the bottom of the receiving cavity 5 of the header housing 4. The slider lock 38 can still be pushed further into the second section 24 of the recess 22 on top of the pin header connector housing 4.

FIG. 9B shows in cross section the slider lock 38 capping the housing 36 in the same stage of assembly as shown in FIG. 10A. At the side of the first indentation 101 the stops 99 have a stop face 99A substantially perpendicular to the assembly direction. The cams 98 have a corresponding stop face 98A, preventing passage of the cams 98 beyond the stop 99.

Figure 9C:
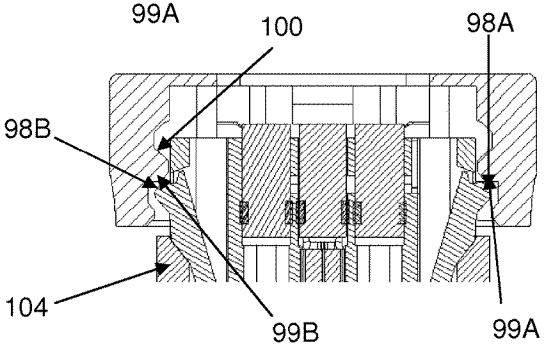
Figure 9D:
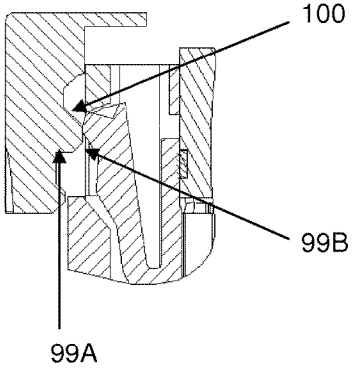
Figure 9E:
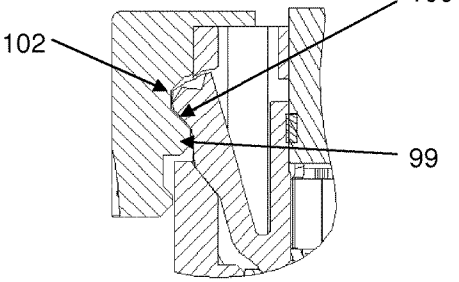

As shown in FIG. 9C, the housing of the pin header connector 2 comprises two inwardly chamfered flanges 104 flanking the receiving opening (see also FIG. 2B). These chamfered flanges 104 engage the flaps 73 of the clip 37 and gradually push the flaps 73 inwardly, until the stop face 98A of the cam 98 does not abut the stop face 99A of the stop 99 anymore. A chamfered edge 98B of the cam 98 now starts abutting a correspondingly chamfered edge 99B of the stop 99, allowing further inward pushing of the flap 73 so the flaps 73 can pass the stop 99. The force needed to push the chamfered edge 98B over the chamfered edge 99B is larger than the sum of the remaining mating forces, which includes friction forces between the pin contacts and the terminal contacts and the force required to drive the latch 86 over the projection 30. This way the slider strip 76 cannot be pushed into the recess 24 before the cable connector 3 is fully mated with the pin header connector 2.

The stop 99 has a sloping face 100. After passing the stop 99 the cam 98 of the flaps 73 snaps into the second indentation 102 (see FIG. 9E), resulting in a second audible click informing the user that the locking of the two connectors 2, 3 is now secured. The sloping face 100 of the stop 99 pulls the flaps 73 and the cable connector 3 upwardly against the top flange 110 of the slider lock 38. As a result, any attempt to unlock the cable connector by pushing on the top flange 110 will fail since it would drive the flaps 73 and the cable connector 3 further into the slider lock 38.

When the cam 98 of the flap 73 is in the second indentation 102 of the slider lock 38, the outer end of the slider strip 76 extends past the outer end of the U-shaped latch 86 into the narrower second section 24 of the recess 22 of the pin header connector 2 (see FIG. 10C). The flaps 73 of the clip 37 are now completely overlapped by the ears 96 of the slider lock 38 and the clip 37 is fully shielded and hidden from view.

In the assembled condition, the top faces of the slider lock 38, the U-shaped latch 86 and the pin header connector housing 4 are all within the same plane. With all latching parts 76, 86 being sunk in corresponding recesses less space is consumed above the circuit board and a very compact build-up is achieved.

As particularly shown in FIG. 11, the tip 106 of the slider lock strip is chamfered. The flanges 26 narrowing the open side of the second section 24 of the recess 22 on the pin header connector housing 4 have contact faces 107 which are chamfered at a corresponding angle. In the final position the chamfered tip 106 will engage the chamfered contact faces 107 and will be pushed down even if the slider lock is slightly tilted during assembly, as shown in FIG. 11.

FIG. 13 shows in cross section the connector assembly 1 of the cable connector 3 with the pin header connector 2. The assembly 1 is similar as the assembly in FIG. 1, with the difference that the pin header connector 2 is held by the hold down members 17 in a vertical position. The slider strip 76 is connected to the top flange 110 with a thickened root section 118 engaging the outer wall of the housing 36 of the cable connector 3. This further fixates the slider lock 38 relative to the housing 36 and prevents any manoeuvrability of the slider strip 76 by pushing the cable entry side of the slider lock 38.

An alternative embodiment of a terminal contact is shown in FIG. 14. The terminal contact 41 is identical to the embodiment shown in FIG. 4, with the difference that the flange 51 carries a traverse flange 120 extending towards the opposite flange 52. This results in a second pin receiving opening 121 in line with the first pin receiving opening 54. To maximize flexibility and manoeuvrability of the terminal contact, a gap may remain between the traverse flange 120 and the flange 51. Alternatively, the traverse flange 120 can be connected to the flange 52, e.g., by welding, gluing or soldering to provide a more rigid structure.

In the shown embodiment of FIG. 14, the third contact beam 48 extends from the first pin receiving opening 54 towards the second pin receiving opening 121. Alternatively, it may extend from the traverse flange 120 towards the first pin receiving opening 54.

A further alternative terminal contact is shown in FIG. 15. Here, the third beam 48 is not a contact beam but a latch with an upwardly sloping tip 122, profiled to latch in cooperation with a matching receiving cavity in the connector housing.

The invention claimed is:

1. A connector comprising one or more terminal contacts, each of the one or more terminal contacts comprising:

a backbone having a first end and a second end, two parallel resilient contact beams attached at the first end of the backbone by two oppositely arranged flanges on sides of the backbone, and a third resilient beam facing the backbone and attached at the second end of the backbone by a third flange, wherein tips of the two parallel resilient beams are forced apart by the third resilient beam, and wherein the two parallel resilient contact beams extend toward the second end of the backbone, and wherein the third resilient beam extends toward the first end of the backbone and extends beyond the tips of the two parallel resilient beams, wherein the third beam is a contact beam and wherein the three contact beams are differently dimensioned.

2. The connector according to claim 1 wherein the third beam is a third resilient contact beam.

3. The connector according to claim 1 wherein the third beam is a latch, the connector comprising a housing part with a cavity configured to receive the third beam in a latching manner.

4. The connector according to claim 1, wherein a gap between the backbone and each of the first beam, the second beam and the third beam provides additional flexibility to the backbone.

5. The connector according to claim 1 wherein a pin receiving opening is confined by:

the third beam;

the third flange bridging the third beam and the backbone;

the backbone; and a fourth flange opposite the third flange.

6. The connector according to claim 5, wherein a gap remains between the fourth flange and the third beam.

7. The connector according to claim 5 wherein the fourth flange is connected to the third beam.

8. The connector according to claim 5, wherein the fourth flange protrudes above an upper face of the third beam.

9. The connector according to claim 8 wherein the projecting end of the fourth flange comprises a hook.

10. The connector according to claim 5, wherein a traverse flange extends between the flanges carrying the first or second contact beams to form a second pin receiving opening in line with the first pin receiving opening.

11. The connector according to claim 5, wherein at least one of the flanges carrying the first or second contact beams protrudes above an upper face of the third contact beam.

12. The connector according claim 5, wherein a traverse flange parallel to a base strip extends from one of the flanges carrying the first or second contact beams towards the other one of the flanges.

13. The connector according to claim 12, wherein the third beam extends from the traverse flange into the same direction as the parallel contact beams.

14. The connector according to claim 1 wherein the terminal contacts float in respective cavities in a connector housing.

15. The connector according to claim 1, wherein the three contact beams and the backbone are profiled to provide staggered contact points to contact a pin of a complementary pin header connector.

16. The connector according to claim 1 comprising a clip with one or more receiving cavities, each cavity receiving a respective terminal contact, the clip being received in an outer housing.

17. The connector assembly according to claim 16, wherein the cavities are configured to facilitate lateral insertion of the terminal contacts.

18. The connector assembly according to claim 17, comprising cavities accessible from a first side of the clip and cavities accessible from an opposite side of the clip.

19. The connector assembly according to claim 17, wherein the cavities comprise snap-fit hooks.

20. The connector according to claim 16, wherein the terminal contacts comprise one or more flags or flanges received in corresponding slits in the receiving cavity in the clip with a press-fit or a clearance fit.

21. The connector according to claim 16, wherein a flange of the terminal contact is provided with a hook pointing towards a cable connection end of the terminal contact, while the clip comprises a snap-fit hook locking the cable connection end of the terminal contact.

22. The connector according to claim 1, wherein the backbone comprises a crimp connection at a cable connecting side and a pin receiving opening at an opposite side which is offset from the cable connecting side to space received contact pins from the crimp connection.

23. The connector according to claim 22 comprising a sloping guiding face between the cable connecting side and the pin receiving opening side.

24. The connector according to claim 22, wherein the terminal contact comprises a partition between the pin receiving opening and the crimp connection.

25. The connector housing of a connector according to claim 1 comprising an outer housing encasing a clip for holding the terminal contacts in line with pin receiving openings in the outer housing.

* * * * *